United States Patent [19]

Söhner et al.

[11] 4,331,122

[45] May 25, 1982

[54] ADAPTER FOR IMPROVING THE OPERATION OF ELECTRICAL CIRCUITS IN A MOTOR VEHICLE

[75] Inventors: Gerhard Söhner, Remshalden; Manfred Mezger, Markgroningen, both of Fed. Rep. of Germany

[73] Assignee: Robert Bosch GmbH, Stuttgart, Fed. Rep. of Germany

[21] Appl. No.: 147,143

[22] Filed: May 6, 1980

[30] Foreign Application Priority Data

Jul. 6, 1979 [DE] Fed. Rep. of Germany ..... 2927295

[51] Int. Cl.[3] ..... F02P 3/04

[52] U.S. Cl. ..... 123/595; 123/645; 123/647; 339/147 R

[58] Field of Search ..... 123/647, 595, 645, 651; 339/147 R, 147 C, 147 P; 315/209 T, 209 SC

[56] References Cited

U.S. PATENT DOCUMENTS 3,874,354 4/1975 Crouch ..... 123/595
3,915,542 10/1975 Schou-Kjeldsen ..... 123/647
4,077,377 3/1978 Jundt et al. ..... 123/645
4,130,101 12/1978 Jundt et al. ..... 123/651

FOREIGN PATENT DOCUMENTS 2558420 7/1977 Fed. Rep. of Germany ... 339/147 R
1521742 8/1978 United Kingdom ..... 123/595

*Primary Examiner*—Charles J. Myhre
*Assistant Examiner*—Andrew M. Dolinar
*Attorney, Agent, or Firm*—Frishauf, Holtz, Goodman & Woodward

[57] ABSTRACT

Adapter plugs are proposed for electronic circuits in motor vehicles which normally receive plug-in units. The adapter plug is interposed between the circuits and the plug-in units and contains circuits which improve the operation of such units. Specifically, in ignition control circuits, the circuitry in the adapter plug can contain a thyristor which is normally blocked, but which shunts energy from the ignition capacitor when the ignition switch is open while the interrupter switch is closed. This prevents the generation of undesired sparks.

2 Claims, 6 Drawing Figures

ADAPTER FOR IMPROVING THE OPERATION OF ELECTRICAL CIRCUITS IN A MOTOR VEHICLE

The present invention relates to adapter circuits for the electrical circuits in a motor vehicle. In particular, it relates to adapter circuits for plug-in units.

BACKGROUND AND PRIOR ART

A plug-in unit for an electronic ignition system in a motor vehicle is described in the publication Bosch-Zünder, No. 3/1977, page 6. After installation, the function and operation of the plug-in unit is fully defined and it is not possible to make any changes in its circuitry without great technical difficulty and attendant cost. On some occasions trouble has resulted from a spark produced just when the engine is stopped by opening the ignition switch.

THE INVENTION

It is an object of the present invention to furnish a unit which can be used to adapt the aforementioned plug-in unit so that such undesired results of its operation are obviated.

DRAWINGS DESCRIBING A PREFERRED EMBODIMENT

Figure 1:
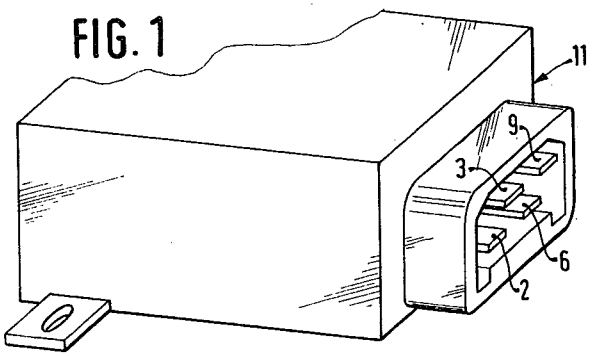
FIG. 1 is a diagram illustrating the construction of a plug-in unit suitable for use in an ignition system of a motor vehicle.
Figure 4:
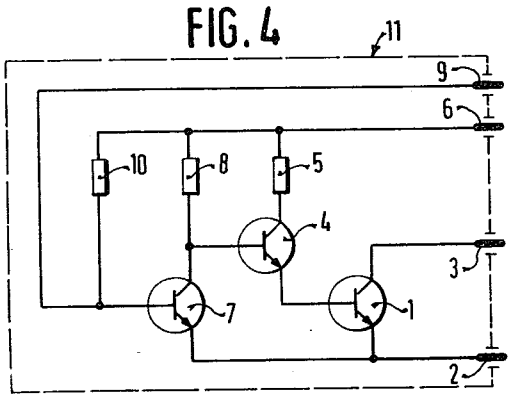
FIG. 4 is a schematic diagram of the circuit in the plug illustrated in FIG. 1.

As shown in FIG. 4, the control circuits housed in plug 11 of FIG. 1 include an npn transistor 1 whose emitter is connected to a prong 2 and whose collector is connected to a prong 3. The base of transistor 1 is connected to the emitter of an npn transistor 4, whose collector is connected through a resistor 5 with a prong 6. The base of transistor 4 is connected to the collector of an npn transistor 7, whose emitter is connected to prong 2 and whose collector is connected through a resistor 8 to prong 6. The base of transistor 7 is connected to a prong 9 and is further connected through a resistor 10 to prong 6. A dashed line labeled 11 indicates the housing of the circuitry in plug 11 of FIG. 1. Prongs 2, 3, 6, 9 of FIG. 1 correspond to prongs 2, 3, 6, 9 of FIG. 4.

Figure 2:
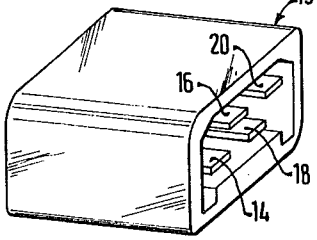
FIG. 2 shows the construction of an adapter plug suitable for use with the unit illustrated in FIG. 1.
Figure 3:
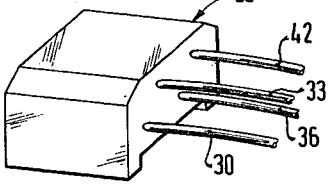
FIG. 3 shows the construction of a plug suitable for receiving the adapter plug output prongs.
Figure 5:
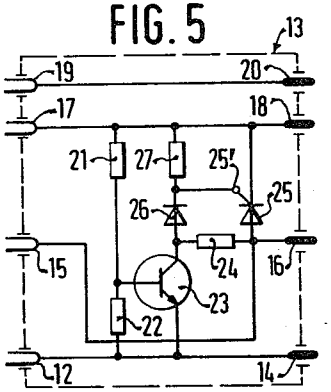
FIG. 5 is a schematic diagram of the circuit housed in the plug illustrated in FIG. 2.
Figure 6:
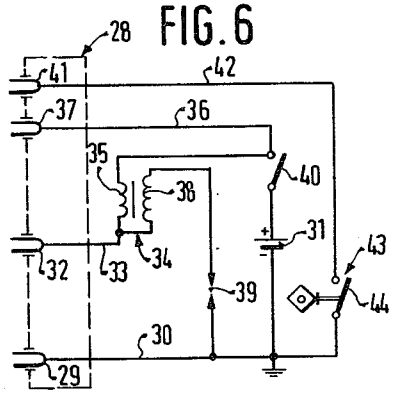
FIG. 6 shows the ignition circuit of the motor vehicle and the sockets in the plug illustrated in FIG. 3.

The circuit of FIG. 5 includes a socket 12 which is to be connected to prong 2 and which, internally of the adapter circuit shown in FIG. 5, is directly connected to output 2 and adapter prong 14. Plug 13 further has a socket 15 which is to engage prong 3 and which is directly connected to an output prong 16 of plug 13. A socket 17 is adapted to be connected to prong 6 and, internally of plug 13, is directly connected to a prong 18. Finally, a socket 19 is directly connected to a prong 20. Socket 19 engages prong 9 when plug 11 is inserted into plug 13. A voltage divider including a resistor 21 and a resistor 22 is connected between the line connecting socket 17 to prong 18 and the line connecting socket 12 to prong 14. The common point of resistors 21 and 22 is connected to the base of a transistor 23. The emitter of transistor 23 is connected to the line connecting socket 12 and prong 14, while its collector is connected through a resistor 24 to prong 16 and through a diode 26 to the gate of a thyristor 25. The gate of thyristor 25 is connected through a resistor 27 to the line connecting socket 17 to prong 18. The anode of thyristor 25 is connected to prong 16, while its cathode is connected to prong 18. It should be noted that sockets 12, 15, 17 and 19 are not visible in FIG. 2, prongs 14, 16, 18, and 20 having the same reference numerals in FIG. 5 as in FIG. 2. A plug, herein referred to as the first plug, and indicated in FIG. 3 by reference numeral 28 includes sockets 29, 32, 37 and 41 (not visible in FIG. 3). Connected to the above-mentioned sockets are, respectively, pins 30, 33, 36 and 42. Socket 29 is to engage prong 14 and is connected to ground or chassis potential. Also connected to chassis potential is the negative side of a battery 31. Socket 32 is connected through pin 33 to the primary winding 35 of a transformer 34. Pin 36 is connected to the other side of primary winding 35. The secondary winding 38 of ignition transformer 34 is connected to a spark gap 39 whose other side is connected to chassis potential. An ignition switch 40 is connected between pin 36 and the positive side of battery 31. Pin 42 is connected to an external ignition signal furnishing switch 43, 44 preferably the standard interrupter switch. The other side of switch 44 is connected to chassis potential. Sockets 29, 32, 37 and 41 are not visible in FIG. 3, but pins 30, 33, 36 and 42 have the same designations in FIG. 3 and FIG. 6.

OPERATION

Let it first be assumed that adapter plug 13 is not used, i.e. that plug 11 is directly inserted into plug 28. Thus, prongs 9, 6, 3, and 2 are respectively inserted into sockets 41, 37, 32 and 29. If the ignition switch 40 is now closed, the ignition system is ready for operation. If interrupter switch 43 is closed, current flows through primary winding 35 of ignition transformer 34 and ignition energy for the next spark is stored, since, for closed interrupter switch 43, transistor 7 is nonconductive and transistors 4 and 1 and conductive. At the ignition time, interrupter switch 43 is opened, which causes transistor 7 and, more specifically, its emitter-collector circuits, to switch to the conductive state therefore causing the emitter-collector circuits of transistors 4 and 1 to be blocked. This, in turn, causes the current through primary winding 35 of ignition transformer 34 to be interrupted. A high voltage pulse is induced in secondary winding 38 which causes a spark to be generated at spark plug 39. When the interrupt switch 43 is again closed, this cycle repeats.

For the above described ignition system, that is for the ignition system without adapter 13, a spark may be generated at a time other than the ignition time causing damage to the internal combustion engine. This can occur if, while interrupter switch 43 is closed, switch 40 is opened. The emitter-collector circuit would then be switched to the blocked state, causing an electrical discharge at spark plug 39, i.e. the generation of an undesired spark.

To remove the possibility of this generation of an undesired spark, the adapter plug 13 is inserted between plugs 28 and 11. The generation of the desired sparks is not prevented by the addition of the adapter circuit, since, for closed switch 40, transistor 23 is always conductive and therefore prevents switching of thyristor 25 to the conductive state. If, however, switch 40 is opened while switch 43 is closed, transistors 23, 1, 4, and 7 will all have blocked emitter-collector circuits. The blocked emitter-collector circuit of transistor 23 causes the voltage induced across winding 35 to generate an induction current through resistor 24, diode 26 and the gate circuit of thyristor 25. This causes thyristor 25 to switch to the conductive state. Energy is shunted from the ignition transformer so that no spark is generated.

The above example illustrates how the functioning of the ignition system can be expanded and improved by the circuitry in the adapter plug. Such improvement and expansion of functioning of other circuits is, of course, possible. For example, the operation of circuits controlling fuel injection can be expanded by circuitry in an adapter plug which, when the engine speed exceeds a predetermined maximum speed, causes the fuel supply to be cut off entirely. This can be accomplished by monitoring the injection pulses by means of a storage and a threshold switch connected to the storage.

The present invention is also not to be limited to a single adapter plug inserted between plug-in units and the sockets receiving the plug-in units. A multiplicity of such plugs can, of course, greatly improve the functioning of the units now present in internal combustion engines.

Various changes and modifications may be made within the scope of the inventive concepts.

We claim:

1. In a motor vehicle ignition system comprising a storage battery (31), an ignition transformer (34) serving for accumulation and storage of ignition energy, an ignition switch (40) interposed between said battery and a winding of said transformer for enabling or disabling operation of the ignition system, spark gap means for producing an ignition spark upon interruption of current in said transformer, an interrupter switch for timing the interruption of current in said transformer, a first plug unit (28) having pins connected at least to said transformer, said interrupter switch and a terminal of said battery and having sockets connected to said pins and arranged in a receptacle, and a second plug unit (11) fitting into said first plug unit and having prongs for engagement into the sockets of the receptacle thereof, and also containing switch means (1,4,7) for interrupting current in said transformer (34) in response to opening of said interruptor switch (44) when said second plug unit is directly connected to said first plug unit, the improvement comprising a third plug unit (13) for interfitting as an adapter in an intermediate position with said first and second plug units having prongs for engagement with the sockets of the receptacle of said first plug unit and a receptacle with sockets for engagement with the prongs of said second plug unit and containing means directly connecting its prongs with its corresponding sockets and means (25) for shunting energy from said ignition transfomer, and thereby preventing generation of an undesired spark, when current in said ignition transformer is interrupted by the opening of said ignition switch while said interrupter switch is closed.

2. In a motor vehicle ignition system comprising a storage battery (31), an ignition transformer (34) serving for accumulation and storage of ignition energy, an ignition switch (40) interposed between said battery and a winding of said transformer for enabling or disabling operation of the ignition system, spark gap means for producing an ignition spark upon interruption of current in said transformer, an interrupter switch for timing the interruption of current in said transformer, a first plug unit (28) having pins connected at least to said transformer, said interrupter switch and a terminal of said battery and having sockets connected to said pins and arranged in a receptacle, and a second plug unit (11) fitting into said first plug unit and having prongs for engagement into the sockets of the receptacle thereof, and also containing switch means (1,4,7) for interrupting current in said transformer (34) in response to opening of said interruptor switch (44) when said second plug unit is directly connected to said first plug unit, the improvement comprising a third plug unit (13) for interfitting as an adapter in an intermediate position with said first and second plug units, having prongs for engagement with the sockets of the receptacle of said first plug unit and a receptacle with sockets for engagement with the prongs of said second plug unit and containing means directly connecting its prongs with its corresponding sockets, a thyristor (25) connected in parallel with said winding of said ignition transformer, means (21,24,26,27) for maintaining said thyristor in the blocked state while said ignition switch is closed and for switching said thyristor to the conductive state whenever said ignition switch is opened while said interruptor switch is closed and thereby preventing an undesired spark from being produced.

* * * * *